US007901323B2

(12) United States Patent
Olason et al.

(10) Patent No.: US 7,901,323 B2
(45) Date of Patent: Mar. 8, 2011

(54) FLEXIBLE DISPLAY ASSEMBLY FOR FITNESS TRAINERS

(75) Inventors: Brady A. Olason, Mukilteo, WA (US); Rodney P. West, Kirkland, WA (US); Blakely Todd Pennington, Everett, WA (US); Victor Pipinich, Seattle, WA (US); Jonathan M. Stewart, Seattle, WA (US)

(73) Assignee: Precor Incorporated, Woodinville, WA (US)

( * ) Notice: Subject to any disclaimer, the term of this patent is extended or adjusted under 35 U.S.C. 154(b) by 1245 days.

(21) Appl. No.: 11/388,565

(22) Filed: Mar. 24, 2006

(65) Prior Publication Data

US 2007/0225121 A1 Sep. 27, 2007

(51) Int. Cl.
*A63B 71/00* (2006.01)

(52) U.S. Cl. ..... 482/8

(58) Field of Classification Search ..... 482/1, 4, 482/6, 8–9, 54; 463/38
See application file for complete search history.

(56) References Cited

U.S. PATENT DOCUMENTS

| | | | | |
|---|---|---|---|---|
| 4,512,567 | A | 4/1985 | Phillips | 272/73 |
| 4,637,605 | A | 1/1987 | Ritchie | 272/73 |
| 4,976,435 | A | 12/1990 | Shatford et al. | 273/148 |
| 5,364,271 | A | 11/1994 | Aknin et al. | 434/61 |
| 5,591,104 | A | 1/1997 | Andrus et al. | 482/7 |
| 5,645,513 | A | 7/1997 | Haydocy et al. | 482/57 |
| 5,765,794 | A * | 6/1998 | Chen | 248/292.12 |
| 5,779,596 | A | 7/1998 | Weber | 482/4 |
| 5,888,172 | A | 3/1999 | Andrus et al. | 482/7 |
| 5,984,839 | A | 11/1999 | Corkum | 482/54 |
| 6,152,856 | A | 11/2000 | Studor et al. | 482/8 |
| 6,447,424 | B1 | 9/2002 | Ashby et al. | 482/8 |
| 6,773,349 | B2 * | 8/2004 | Hussaini et al. | 463/38 |
| 2001/0053735 | A1 | 12/2001 | Cohen et al. | 482/902 |
| 2002/0128112 | A1 | 9/2002 | Hanatani | 475/349 |
| 2002/0165067 | A1 * | 11/2002 | Watterson et al. | 482/54 |
| 2003/0171190 | A1 | 9/2003 | Rice | 482/57 |
| 2004/0014566 | A1 | 1/2004 | Kao | 482/8 |
| 2004/0092367 | A1 * | 5/2004 | Corbalis et al. | 482/54 |
| 2004/0236774 | A1 | 11/2004 | Baird et al. | 707/100 |
| 2007/0111858 | A1 * | 5/2007 | Dugan | 482/8 |
| 2007/0161459 | A1 * | 7/2007 | Watson | 482/8 |
| 2007/0287596 | A1 * | 12/2007 | Case et al. | 482/8 |

FOREIGN PATENT DOCUMENTS

| | | | |
|---|---|---|---|
| EP | 1 527 801 A2 | | 5/2005 |
| WO | WO 00/69525 | | 11/2000 |
| WO | WO 0069525 | * | 11/2000 |
| WO | WO0069525 | * | 11/2000 |

* cited by examiner

*Primary Examiner* — Loan Thanh
*Assistant Examiner* — Shila Abyaneh
(74) *Attorney, Agent, or Firm* — Terence P. O'Brien; Todd A. Rathe; Paul E. Schaafsma

(57) ABSTRACT

In accordance with the principles of the present invention, a display system for a fitness trainer is provided. The display system includes a processor, a hardware circuit board in communication with the processor, and a memory in communication with the hardware circuit board and the processor. A base portion is provided in communication with the processor and the memory. The base portion provides exercise information to the user. At least two modules are provided that can be removably attached to the base portion. In one embodiment, the removable modules comprise entertainment modules.

26 Claims, 9 Drawing Sheets

FLEXIBLE DISPLAY ASSEMBLY FOR FITNESS TRAINERS

FIELD OF THE INVENTION

The present invention relates to fitness equipment.

BACKGROUND OF THE INVENTION

From their humble beginnings as free weights and bicycles mounted on wooden platforms, exercise equipment such as stationary bicycles, treadmills, elliptical fitness trainers, rowing machines, stair climbers, weight resistance machines, and the like have grown increasingly sophisticated. The mechanical aspects of these machines have markedly improved, with innovations such as adjustable platforms, variable resistance, and a range of exercising positions. Thus, today's exercise equipment offers users a wide variety of different exercise patterns; not only patterns designed to burn a specified number of calories or cover a specified distance, but also complex workout patterns such as interval workouts, course patterns, etc.

Unfortunately, many users find spending long hours doing repetitive forms of stationary exercise hard work and boring, sometimes so much so that the exercise equipment is abandoned in favor of something more entertaining. In an attempt to relieve the tedium of using such exercise equipment, users often utilize portable music playing equipment while health clubs have resorted to installing televisions for exercisers to watch. In the most sophisticated of health clubs, often walls of televisions tuned to various stations are installed in the exercise room. Users can tune into the audio of their chosen station on personal headsets.

While these systems help provide entertainment to exercisers, the purchase and installation of multiple large screen televisions that can be seen from a distance is prohibitively expensive. Also, the act of watching a television station surrounded by a wall of competing stations can be perplexing to the exerciser. Finally, the size of the televisions combined with the physical limits of available space means that, even with all the effort and expense the exerciser is granted limited choices.

Further, individuals, health clubs and other exercise facilities have varying needs, which often change over time. The needs of these different users vary based upon the available budget to purchase equipment, the space and technology in place to support the exercise equipment, fitness level, and interest level in audio/visual entertainment.

Thus, it would be advantageous to provide an exercise device that can be equipped with varying levels of features. For example, it would be desirable to offer various options of entertainment to exercisers. It would be further desirable to offer various options of entertainment to exercisers at reasonable costs. Further, it would be advantageous to provide a system that could be upgradeable to meet a user's changing needs, and to offer users more options and the ability to select an exercise device that best fits their particular needs.

SUMMARY OF THE INVENTION

A flexible display assembly for fitness trainers in accordance with the principles of the present invention offers various options for entertaining user and for controlling and monitoring the fitness trainer or exercise device. A flexible display assembly for fitness trainers in accordance with the principles of the present invention offers such options of entertainment at reasonable costs. A flexible display assembly for fitness trainers in accordance with the principles of the present invention combines the advantages of multiple customer choice of entertainment options with economies of scale in production, inventorying, warehousing, etc. to help keep the costs of such entertainment reasonable.

In accordance with the principles of the present invention, a display assembly system for a fitness trainer includes a base module and a supplemental module. The base module includes a processor, a hardware circuit board in communication with the processor, memory in communication with the hardware circuit board and the processor, and a first front operating surface. The first front operating surface includes at least one control and at least one display window disposed on the front operating surface. The supplemental module is removably coupled to the base module and includes a second front operating surface.

According to a principal aspect of the invention, a display system for a fitness trainer includes a base portion having exercise information and at least two removable modules that can be connected to the base portion.

According to another principal aspect of the invention, a display system for an exercise device includes a main body having a first front operating surface, a processor, a hardware circuit board, memory, at least one control, at least one display window and a primary control region. The hardware circuit board is in communication with the processor, and the memory is in communication with the hardware circuit board and the processor. The processor, the circuit board and the memory positioned within the body. The at least one control and the at least one display window are disposed on the front operating surface and are operably engaged with the processor. The primary control region outwardly projects from the first front operating surface of the main body. The primary control region has a second front operating surface spaced apart from the first operating surface.

BRIEF DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION OF THE INVENTION

While an exemplary embodiment of the invention has been illustrated and described, it will be appreciated that various changes can be made therein without departing from the spirit and scope of the invention.

Figure 1:
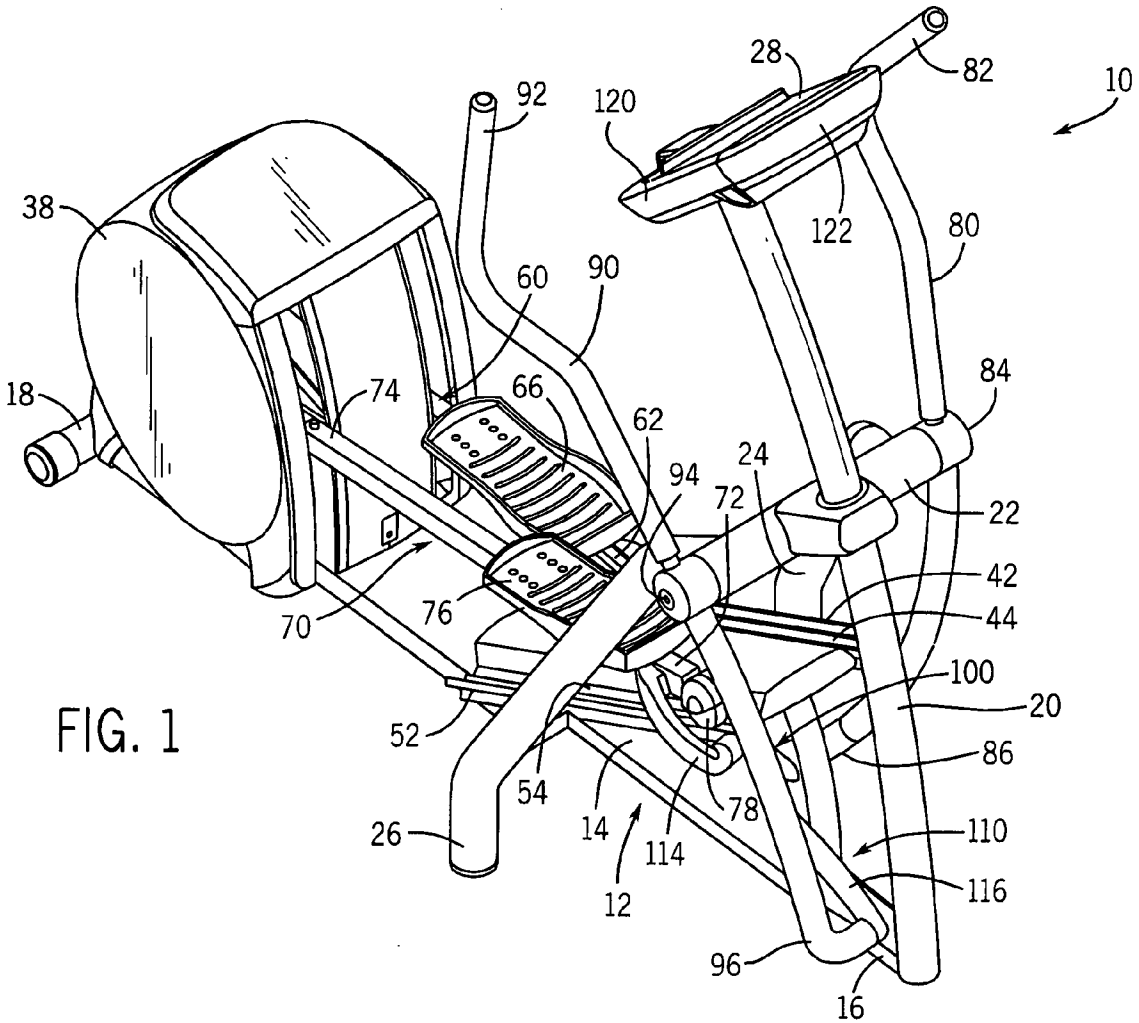
FIG. 1 illustrates an elevated front perspective view of an example fitness device in accordance with the principles of the present invention.
Figure 2:
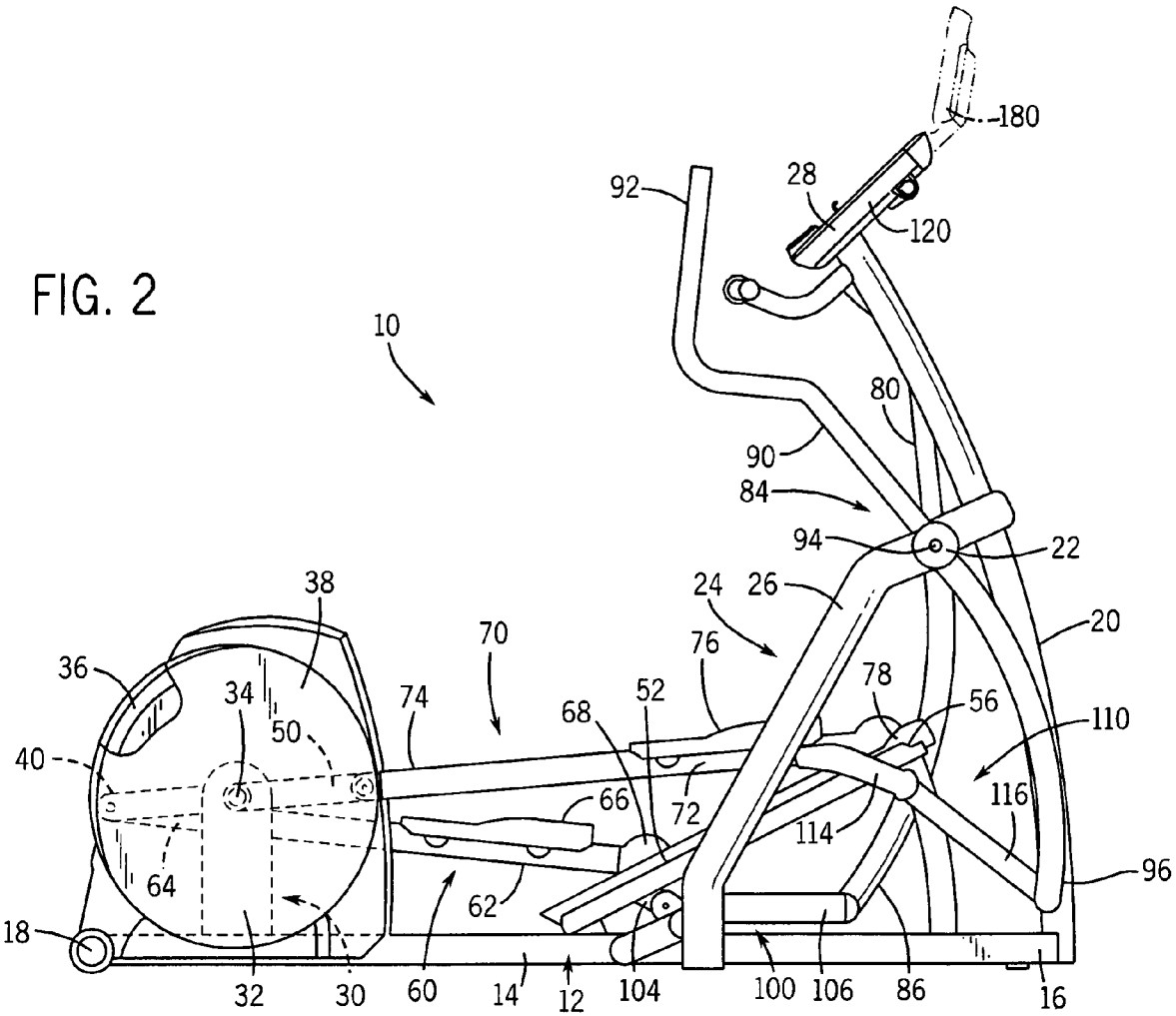
FIG. 2 illustrates an elevated, side view of the fitness device of FIG. 1.

FIGS. 1-2 illustrate an example embodiment of a fitness device in the form of a total body elliptical fitness cross-training device 10 suitable for use with the present invention. While the example embodiment described herein is a Precor® Elliptical Fitness Cross-trainer (available from Precor Incorporated, Woodinville, Wash. 98072 USA), the principles of the present invention apply to any other fitness devices, including but not limited to treadmills, stair climbers, stationary bikes, rowing machines, other configurations of elliptical exercise devices, weight resistance machines and the like.

Briefly described, the fitness device 10 includes a frame 12 that has a forward upright member 20, a forward end portion 16 and a rearward end portion 18. Preferably, the forward end portion 16 of the frame 12 can simply terminate at the end of a substantially horizontal, longitudinal central member 14, while the rearward end portion 18 can terminate at a relatively shorter transverse member. Ideally, but not essentially, the frame 12 can be composed of tubular members that can be relatively light in weight but that provide substantial strength and rigidity. The frame 12 also may be composed of solid members that provide the requisite strength and rigidity while maintaining a relatively light weight.

The forward upright member 20 extends upwardly from the longitudinal central member 14 of the frame 12. Preferably, the upright member 20 can be slightly rearward curved; however, the forward member 20 may be configured at other upward angles. A relatively short, transversely oriented crossbar member 22 can be connected to the forward upright member 20. Left and right balance arms 24, 26 can depend downwardly from each end of the crossbar member 22 to engage the floor on each side of the longitudinal central member 14 near the forward end of the fitness device 10, thereby increasing stability. Ideally, but not essentially, these members can be composed of a material similar to that described above, and can be formed in quasi-circular tubular configurations.

Left and right axle mounts 30, 32 (seen in FIG. 2) extend upwardly towards the rear region of the frame 12. The axle mounts 30, 32 support a transverse axle 34 that can be preferably operatively connected to a flywheel 36 contained within a center housing 38. The regions of the axle mounts 30, 32 which house the ends of the transverse axle 34, can contain low friction engaging systems, such as bearing systems (not shown), to allow the transverse axle 34 to rotate with little resistance within the housing in the axle mounts 30, 32. The transverse axle 34 also may be operatively connected to a capstan-type drive (not shown) in some embodiments, to allow the axle 34 to rotate in one direction.

The left and right ends of the transverse axle 34 rotatably engage left and right crank arm assemblies 40, 50. Left and right foot links 60, 70 each include a forward end 62, 72, a rearward end 64, 74, and a foot support portion 66, 76 there between. The foot support portions 66, 76 are positioned near the forward portion of the foot links 60, 70, and provide stable foot placement locations. The foot links 60, 70 are aligned in approximately parallel relationship with the longitudinal central member 14 of the frame 12. The rearward ends 64, 74 of the foot links 60, 70 engage the crank arm assemblies 40, 50 such that the foot support portion 66, 76 of the foot links travel in a generally arcuate or elliptical reciprocal path as the transverse axle 34 rotates. In some exemplary embodiments, the foot support portions 66, 76 can be configured to form toe straps and/or toe and heel cups (not shown) which aid in forward motion recovery at the end of a rearward or forward striding motion of a foot.

The forward ends 62, 72 of the foot links 60, 70 preferably are supported by rollers 68, 78, which engage guide tracks 42, 52 (best seen in FIG. 1) that are mounted to the frame 12. Preferably, the engagement rollers 68, 78 can be actually pairs of rollers. The engagement rollers 68, 78 rotate about axles that are affixed to the forward portions 62, 72 of the foot links 60, 70. In one embodiment, the guide tracks can be statically mounted to the frame 12. The guide tracks 42, 52 can be completely separate members or can be part of one single connected unit. The guide tracks 42, 52 attach to the longitudinal central member 14 of the frame 12 at an angled inclination. In one embodiment, the angle of inclination can be approximately thirty degrees (30°). In an alternative embodiment, the guide tracks can incorporate a mechanism such as a motor (not shown) and a lead screw (not shown) for selectively adjusting the inclination of the guide tracks. The lower ends of the guide tracks 42, 52 are secured to the frame 12 by a hinged mounting while the upper ends of the guide tracks 42, 52 are secured to an adjustable guide.

Preferably, the upper surface of the guide tracks 42, 52 can be shaped to contain two longitudinally extending, adjacent engagement grooves 44, 54 (seen in FIG. 1). These engagement grooves 44, 54 give the upper surface of the guide tracks 42, 52 a generally "W-shaped" cross-sectional configuration. The engagement grooves 44, 54 are specifically sized and shaped to correspondingly mate with the rollers 68, 78 of the foot links 60, 70 in order to assist in the lateral containment of the rollers 68, 78 on the guide tracks. During use of the fitness device 10, the engagement rollers 68, 78 at the front of the foot links 60, 70 translate back and forth the length of the guide tracks 42, 52 in rolling engagement within the grooves 44, 54, as the foot support portions 66, 76 of the foot links 60, 70 travel in an arcuate path of motion, and the rearward portions 64, 74 of the foot links 60, 70 rotate about the transverse axle 34.

The forward ends 62, 72 of the foot links 60, 70 can be operatively connected to engagement assemblies 100, 110, which in turn can be operatively connected to the coupling regions 86, 96 of left and right swing arm mechanisms 80, 90, respectively. Each swing arm mechanism 80, 90 contains a hand-gripping portion 82, 92, a pivot point 84, 94, and a coupling region 86, 96. The pivot points 84, 94 rotatably secure the swing arm mechanisms 80, 90 to each end of the crossbar member 22 of the frame 12. The coupling regions 86, 96 of the swing arm mechanisms 80, 90 rotatably connect to the engagement assemblies 100, 110, and turn to the foot support portions 66, 76 of the foot links 60, 70. Each engagement assembly 100, 110 includes an abutment arm 106, 116 and a curved attachment link 104, 114, which together prevent the derailment of the foot link rollers 68, 78 from the guide tracks 42, 52.

The hand-gripping portions 82, 92 of the swing arm mechanisms 80, 90 are grasped by the hands of the user, and allow upper body arm and shoulder exercising motions to be incorporated in conjunction with the reciprocal, elliptical exercising motion traced out by the feet of the user. The linking of the swing arm mechanisms 80, 90 to the foot links 60, 70, via the engagement assemblies 100, 110, and the rotational securement of the swing arm mechanisms 80, 90 to the forward upright member 20 of the frame 12 at the pivot points 84, 94, results in generally rearward, arcuate motion of a hand-gripping portion being correspondingly linked to a generally forward, arcuate motion of a respective foot support portion, and vice versa.

To use this fitness device 10, the user stands on the foot support portions 66, 76 and grasps the hand-gripping portions 82, 92. The user shifts his or her weight to impart a downward force upon one of the foot support portions while applying less weight to the other foot support portion, thereby causing the transverse axle 34 to rotate in a clockwise direction (when viewed from the right side as shown in FIGS. 1 and 2), due to the crank arm assemblies 40, 50 coupling the motion of the foot links 60, 70 to the rotation of the transverse axle 34. In conjunction with the lower body action, the user also imparts a substantially forward pushing motion on one of the hand-gripping portions and a substantially rearward pulling motion on the other hand-gripping portion. Due to the rotatable connection of the coupling regions 86, 96 of the swing arm mechanisms 80, 90 to the forward portions 62, 72 of the foot links 60, 70 (via the engagement assemblies), and the rotational securement of the swing arm mechanisms 80, 90 to the forward upright member 20 of the frame 12 at their pivot points 84, 94, each hand-gripping portion moves forward as its respective foot support portion moves rearward, and vice versa.

The foot links 60, 70 are attached to the transverse axle 34 by the crank arm assemblies 40, 50 such that one foot support portion moves substantially forward as the other foot support portion moves substantially rearward. In this same fashion, one hand-gripping portion moves forward as the other hand-gripping portion moves rearward (e.g., when the left hand-gripping portion 82 moves forward, the left foot support portion 66 moves rearward, while the right foot support portion 76 moves forward and the right hand-gripping portion 92 moves rearward). Therefore, the user can begin movement of the entire foot link and swing arm mechanism linkage by moving any foot support portion or hand-gripping portion, or preferably by moving all of them together.

Again, while the example embodiment depicts a total body elliptical fitness cross-training device, the principles of the present invention apply to any other fitness devices, including but not limited to treadmills, stair climbers, stationary bikes, rowing machines, other configurations of elliptical exercise devices, weight resistance machines and the like.

Figure 3:
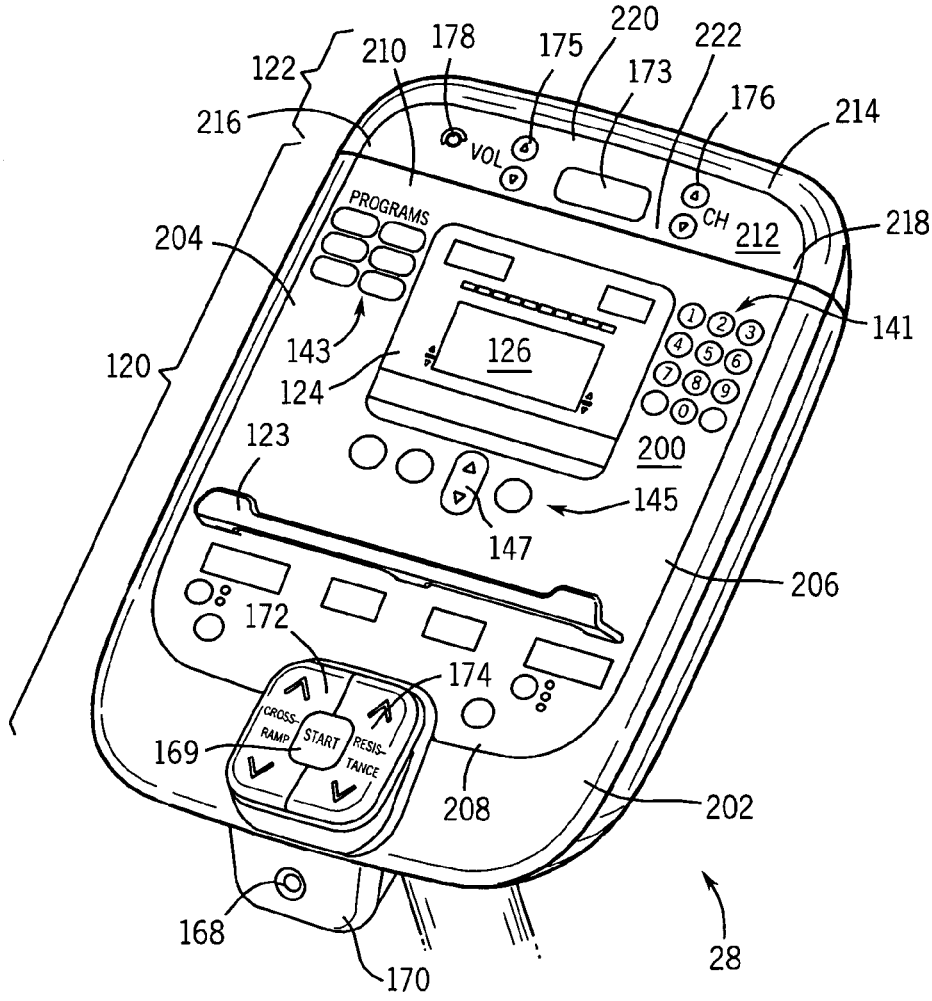
FIG. 3 shows a perspective view of one embodiment of a flexible display assembly in accordance with the principles of the present invention.
Figure 4:
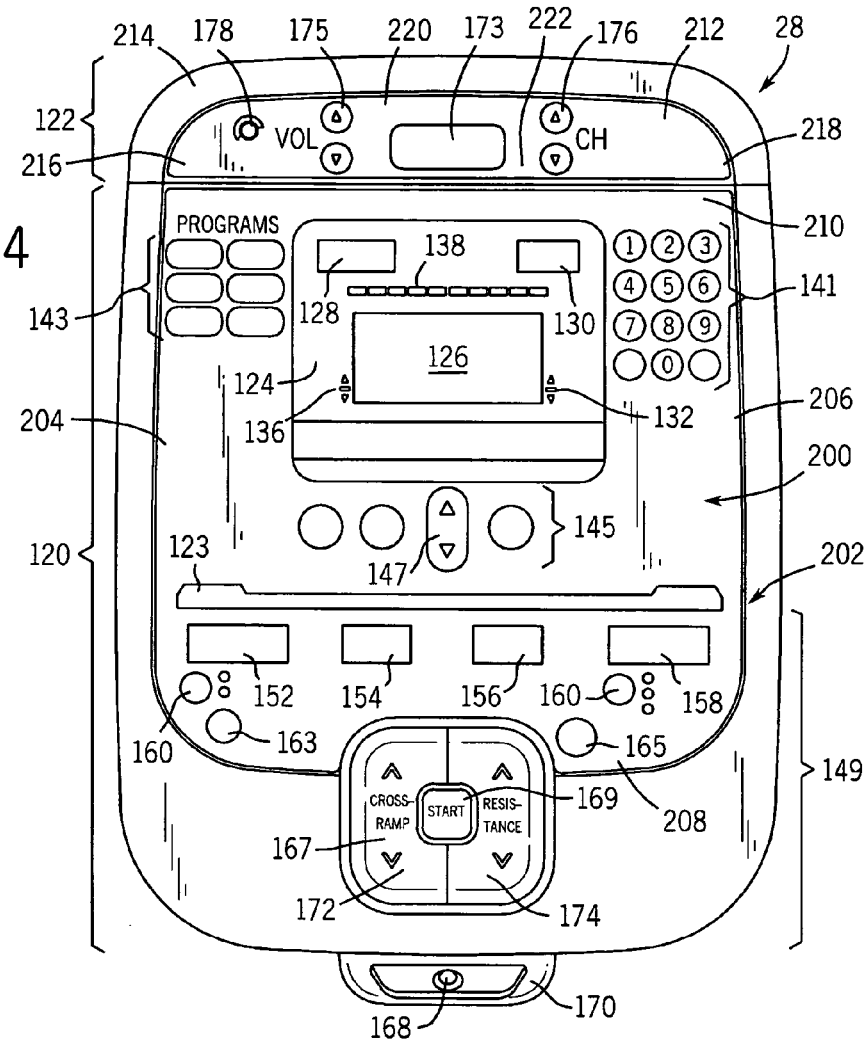
FIG. 4 shows a detailed view of the flexible display assembly of FIG. 3.

In accordance with the principle of the present invention, a flexible display assembly 28 is securely connected to the upper end of the forward upright member 20, at an orientation that can be easily viewable to a user of the fitness device 10. Referring to FIG. 3, a perspective view of one embodiment of a flexible display assembly 28 in accordance with the principle of the present invention is seen while FIG. 4 shows a detailed view of the flexible display assembly of FIG. 3.

Figure 5:
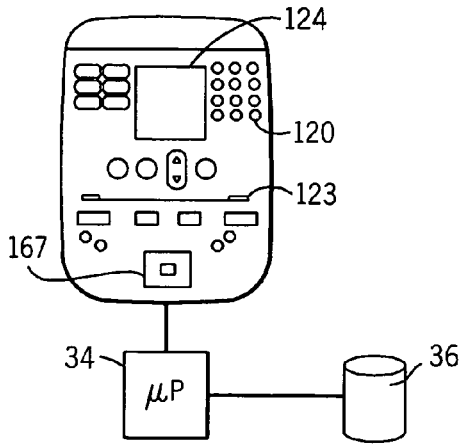
FIG. 5 shows a schematic of an example architecture of a flexible display assembly in accordance with the principles of the present invention.

Referring to FIG. 5, a schematic of example architecture of a flexible display assembly in accordance with the principles of the present invention is seen. The flexible display assembly 28 can include a microprocessor 34 that is connected to the display 29 and to the various keyboard interfaces. The microprocessor 34 is further connected to memory 36. In one embodiment, the flexible display assembly 28 can include a display console circuit board such as a T2 board; the microprocessor can be a microcontroller such as for example an Atmel ATmega128 mega1 microprocessor with 16 MHz clock available from Atmel Corporation, 2325 Orchard Parkway, San Jose, Calif. 95131 USA; the memory can be flash memory, Erasable Programmable Read-Only Memory (EPROM); Random Access memory (RAM); and Electrically Erasable Programmable Read-Only Memory (EEPROM).

The T2 board can include a connector for loading and reading flash and EEPROM memory. The connector can be for example a JTAG connector available from JTAG Technologies Inc., 1006 Butterworth Court, Stevensville, Md. 21666 USA. Multiple serial ports can be provided for: communications with the local processor; Communication Specification for Fitness Equipment (CSAFE) communications; and USB, wireless or other form of network interface.

Electronic devices may be incorporated into the fitness device 10 such as timers, odometers, speedometers, heart rate indicators, energy expenditure recorders, controls, etc. To allow time-stamping of workout records, an internal clock with an internal battery backup and a user interface to allow the user to adjust the time can be provided. A speed sensor can be preferably provided. In one embodiment, the speed sensor can be based on zero crossing of one phase of a SPAM generator, 51 pulses per revolution or 2 strides. A resistance can be provided by a generator or a brake assembly. The display assembly 28 can also heart rate interface including a heart rate receiver and display window. In one embodiment the heart rate receiver can be supplied from Polar Electro Inc., 1111 Marcus Avenue, Suite M15, Lake Success, N.Y. 11042 USA.

Referring back to FIGS. 3 and 4, the flexible display assembly 28 conveys information both to and from the user. The flexible display assembly 28 comprises a base unit 120 and a first upper module 122. The base unit 120 has a generally planar front operating surface 200 including a plurality of controls and display windows. The base unit 120 further including an edge region 202 generally framing at least three side edges of the operating surface 200. In one embodiment, the front operating surface 200 has first and second side edges 204 and 206 and lower and upper edges 208 and 210, and the edge region 202 is positioned adjacent only the first and second side edges 204 and 206 and the lower edge region 206. The edge region 202 does not extend along the upper edge 210 of the front operating surface 200 of the base unit 120.

The base unit 120 can include a publication holder 123 best seen in FIG. 3. The base unit 120 also includes a display area 124 that, in one embodiment, can comprise a central screen 126 and first and second peripheral displays 128, 130. The central screen 126 can be used to select and monitor the most frequently used exercise programs from a single layer list while less frequently used exercise programs may also be accessed through a deep display list. Such programs can be related to time, calories, metabolic equivalents (METs), distance or other factors. In one embodiment, the first peripheral screen 128 can display calories burned and the second peripheral screen 130 can display heart rate. A scroll key 132 can be provided to enable a user to scroll the contents of the central screen 126. In addition, ramp increment/decrement arrows 136 can be provided to control the angle of the exercise platform. The base unit 120 can also include one or more bar displays comprising a series of light emitting diodes (LEDs) 138. The bar displays 138 can be provided that represent and communicate the progress of the user's exercise, such as for example, "warm up" to "fat burn" to "cardio" to "peak high."

A display control area 145 can be provided that can include increment/decrement arrows 147, a "back" button, an "options" button, and an "OK" button. The base unit 120 can further include a numerical key area 141 that includes the numerals 0-9 as well as a clear key and an input key. In one preferred embodiment, the numerical key area 141, or other controls on the base unit 120, can be used to operate audio and/or visual components positioned either above, or remote from, the base unit 120. In addition, a programs key area 143 can be provided that can include a plurality of pre-programmed generic or user specific exercise routines or programs, for example, a "manual" program key, a "heart rate" program key, an "interval" program key, a "weight loss" program key, a "variety" program key, and a "performance" program key.

The base unit 120 can further include a lower base area 149. The lower base area 149 can comprise a plurality of peripheral display areas that can display for example "time elapsed"/"time remaining" 152, "incline" 154, "speed" 156, and "distance"/"pace"/"average speed" 158. The "time elapsed"/"time remaining" display 152 and the "distance"/"pace"/"average speed" display 158 can include display selection buttons 160 for the user to select from the available display options. Additional control buttons such as for example "time +/−" adjust 163 and "pause/reset" 165, resistance level can be provided.

Preferably, the lower base area 149 further includes a centrally positioned, raised "on-the-fly" input area 167. The "on-the-fly" input area 167 can include a "quick start" button 169, pursuant to which the user can start the fitness device with a single input function. In addition, crossramp adjust increment/decrement arrows 172 and resistance adjust increment/decrement arrows 174 can be provided on the "on-the-fly" input area 167. The crossramp adjust increment/decrement arrows 172 enables the use to change the crossramp setting of the exercise device with a single control input at any time during the workout; likewise, the resistance adjust increment/decrement arrows 174 enables the use to change the resistance setting of the exercise device with a single control input at any time during the workout. For other exercise devices the "on-the-fly" input area 167 can include alternative controls such as for example incline and speed for treadmills. Thus, the "on-the-fly" input area 167 allows the user can to start and adjust the fitness device with single control inputs at any time during the workout.

The "on-the-fly" input area 167 provides the user with an optimally centrally positioned control unit with primary exercise equipment controls advantageously configured on the input area 167 for easy operation by the user. The input are is preferably raised with respect to a front operating surface 200 of the base unit 120 to facilitate the user's ability to locate and operate the primary controls positioned on the input area 167. The input area 167 defines a front operating surface that is substantially parallel to the front operating surface 200 of the base module 120. The raised configuration of the input area 167 also protects the critical controls of the input area 167 from moisture or debris which may impact the display assembly 28 during operation. Through the prominent placement of the critical exercise device controls onto the input area 167, a user can readily locate the critical exercise device controls required to operate the exercise machine. The input area 167 facilitates a user's ability to determine how to operate the exercise device by optimizing the location of the more important exercise equipment controls in a centralized easily manipulated location. In an alternative preferred embodiment, the input area can be configured with a different number of critical controls, such as, for example, only a quick start button 169 and a single increment/decrement control.

It is an advantage of the flexible display assembly of the present invention that the base unit publication holder 123 is oriented such that, if the user places a publication on the base unit 120 the lower base area 149 of the base unit remains visible. As such, various displays such as for example "time elapsed"/"time remaining" 152, "incline" 154, "speed" 156, and "distance"/"pace"/"average speed" 158 remain visible to the user. In addition, various controls such as for example display selection buttons 160, additional control buttons, and the "on-the-fly" input area 167 remain accessible to the user. Thus, preferably, the more operationally significant controls and display areas are positioned below the publication holder 123 to allow for a user to operate and adjust the exercise device without having to reposition or remove a publication placed on the publication holder 123 in order to access a control or a display unit.

In alternative preferred embodiments, the base unit 120 can include other arrangements of display areas, control areas, input areas and controls. Accordingly, the location, the number and the function of the various display areas and controls can be adjusted to meet a particular application or to meet the needs of a particular user or groups of users.

The first upper module 122 of the display assembly 28 is removably coupled to and encloses the upper end of the base unit 120. The first upper module 122 includes a generally planar front operating surface 212 surrounded by an upper module edge region 214 positioned adjacent to at least three side edges of the front operating surface 212. In a particularly preferred embodiment, the upper module edge region 214 is positioned against third and fourth side edges 216 and 218, and an upper side edge 220, but not adjacent to a lower edge 222 of the front operating surface 212. Accordingly, when coupled to the base unit 120, the first upper module 122 and the base unit 120 form a distinctive, aesthetically-pleasing generally rectangular shape having curved corners. The upper side edge 210 of the front operating surface 200 of the base unit 120 is positioned generally adjacent to the lower edge 222 of the front operating surface 212 of the first upper module 122 to produce a generally planar and generally continuous operating surface that is surrounded by the base unit edge region 202 and the first upper module edge region 214.

The first upper module 122 is configured to conform to and complement the shape of the base unit 120. In one preferred embodiment, the first upper module 122 and the base unit 120 combine to form a generally rectangular shaped display assembly 28 having curved corners. In alternative preferred embodiments, the base unit 120 and the first upper module can combine to form other shapes, such as, for example, circular, oval, polygonal, etc. The first upper module 122 can further include one or more controls or display windows.

In one preferred embodiment, the first upper module 122 of the flexible display assembly 28 of FIGS. 3 and 4 comprises an entertainment module. The first upper module 122 of the flexible display assembly 28 of FIGS. 3 and 4 provides for audio entertainment. The module provides a digital display 173 that can display for example the frequency of a radio station, or other entertainment related value. In addition, a CD or MP3 player can be provided. Volume increment/decrement arrows 175 and channel increment/decrement arrows 176 are provided. In addition, a mute button 178 can be provided. Thus, the embodiment of a flexible display assembly 28 in accordance with the principle of the present invention is seen in FIGS. 3 and 4 provides for exercise display and control and audio entertainment.

A jack assembly 168 can also be provided on the base unit 120, such as in a housing 170 removably coupled to the base unit 120. Preferably, the jack assembly 168 is advantageously positioned at the central lower region of the base unit 120. This central low position allows for easy to access, reduced headphone cord length, and reduced cord interference during use. The jack assembly 168 can be configured to be either originally installed by factory workers or installed by service engineers at a later date as an upgrade. Accordingly, the jack assembly 168 is another upgradeable feature that can be incorporated into an original display assembly or added to an existing assembly at a later date, such as in conjunction with an upgrade in the upper module.

In alternative preferred embodiments, the first upper module 122 can include one or more controls and/or display windows relating to the operation of the exercise device, or a combination of entertainment controls and exercise device controls. In another alternative preferred embodiment, a cooling fan configured for cooling the user can be incorporated within the first upper module. In yet another alternative preferred embodiment, as shown in FIG. 5, the first upper module can be configured without controls or display windows and serve solely as a structural cap or cover for the display. In other alternative preferred embodiments, audio speakers and/or a music docking device, such as an Apple® iPod®, can be incorporated in the base unit or the upper module.

Figure 6:
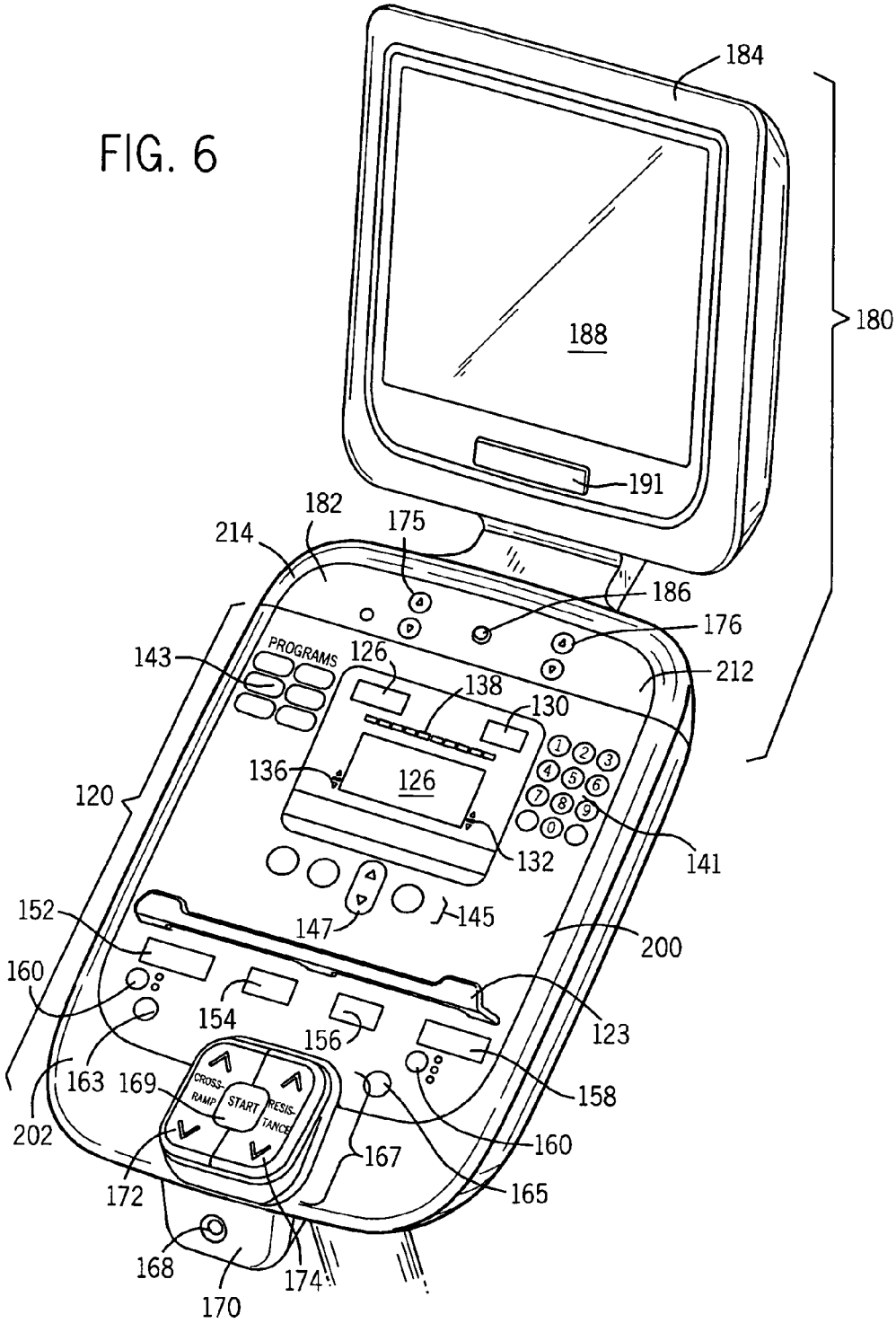
FIG. 6 shows a perspective view of another embodiment of a flexible display assembly in accordance with the principles of the present invention.
Figure 7:
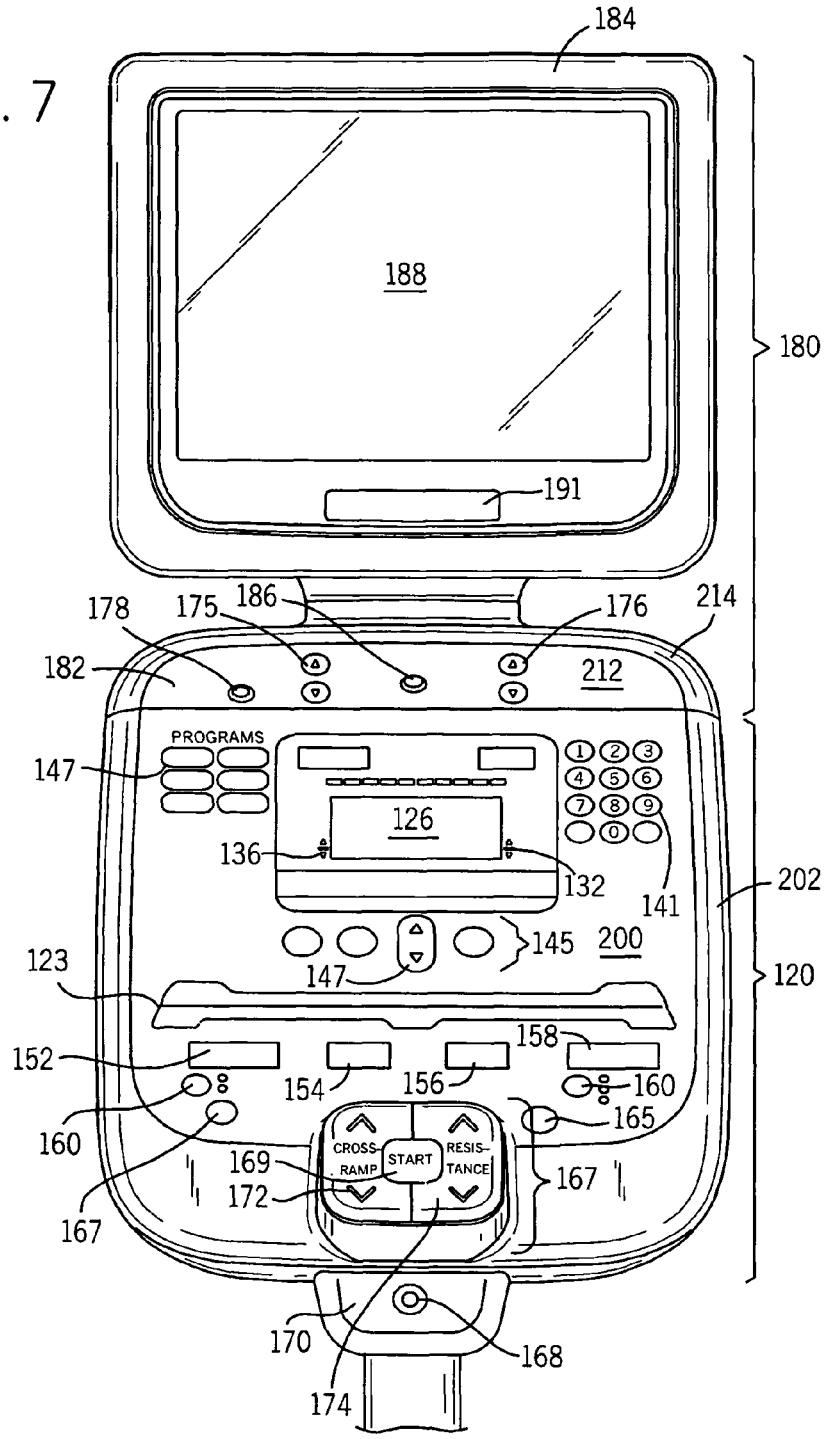
FIG. 7 shows a detailed view of the flexible display assembly of FIG. 6.

FIG. 6 shows a perspective view of another embodiment of a flexible display assembly in accordance with the principles of the present invention while FIG. 7 shows a detailed view of the flexible display assembly of FIG. 6, including a second upper module 180. The second upper module 180 of the display assembly 28 is removably coupled to and encloses the upper end of the base unit 120. Like the first upper module 122, the second upper module 180 is also configured to complement the shape of the base unit 120 to provide the display assembly 28 with a clean, aesthetically-pleasing appearance. In one preferred embodiment, the second upper module 180 also includes the front operating surface 212 and the upper module edge region 214. In one preferred embodiment, the second upper module 180 of FIGS. 6 and 7 also comprises an entertainment module. Alternatively, the second upper module can also include one or more exercise device controls, display windows, or other indicators. The flexible display assembly of FIGS. 3 and 4 differs from the flexible display assembly of FIGS. 6 and 7 in that the flexible display assembly of FIGS. 6 and 7 comprises an enlarged, detailed entertainment module having additional display capabilities; the flexible display assembly of FIGS. 3 and 4 is the same as the flexible display assembly of FIGS. 6 and 7 in that both flexible display assemblies comprise the same base unit. In particular, the flexible of FIGS. 3 and 4 provided for audio entertainment only while the flexible display assembly of FIGS. 6 and 7 provides for audio/video entertainment.

Thus, the module 180 of FIGS. 6 and 7 includes a base unit cap 182 and a personal viewing video display 184. Again, a jack assembly 168 can be provided on the base unit 120, such as in housing 170 provided on the bottom side of the base unit 120. The module 180 provides a power button 186 as well as volume increment/decrement arrows 175, channel increment/decrement arrows 176, and a mute button. In addition, a DVD player can be provided. The personal viewing video display 184 includes a video display screen 188. In one embodiment, the video display screen 188 can comprise a twelve-inch LCD display. The personal viewing video display 184 includes a video display screen 188. The personal viewing video display 184 can further include a video information screen 191; alternatively, the video display screen 188 itself can display information regarding the video.

It is a particular advantage of the present invention that various options of the modules can be provided to customers purchasing exercise equipment. While completely different exercise equipment models could be manufactured, inventoried, warehoused, etc. for each of the different options customers can be offered in these modules, production, inventorying, warehousing, etc. of multiple different models would be costly, failing to take advantage of economies of scale. The present invention combines the advantages of multiple customer choice of options with economies of scale in production, inventorying, warehousing, etc. that helps to keep the costs of such exercise machines reasonable. Further, the present invention allows for the same exercise device to be upgraded over time from one embodiment of the display assembly to another with more or different features. The display assembly of the present invention provides the versatility and flexibility to meet the needs of a wide variety of different users or user groups. Further, the present invention allows for the needs of the same users to be met even as they change over time.

Figure 8:
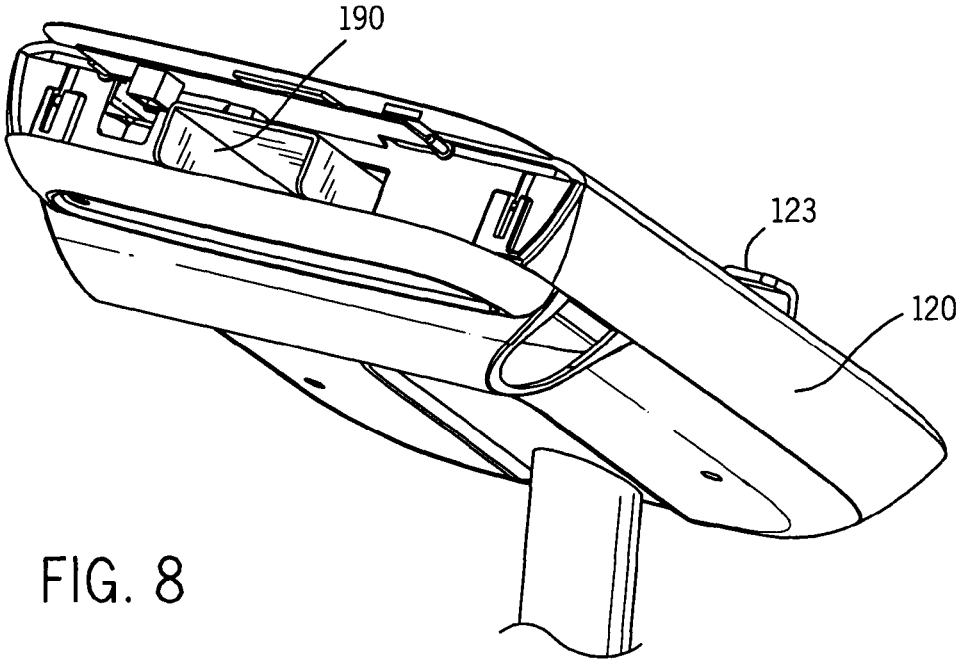
FIG. 8 shows a rear perspective view of a base unit of a flexible display assembly in accordance with the principles of the present invention.
Figure 9:
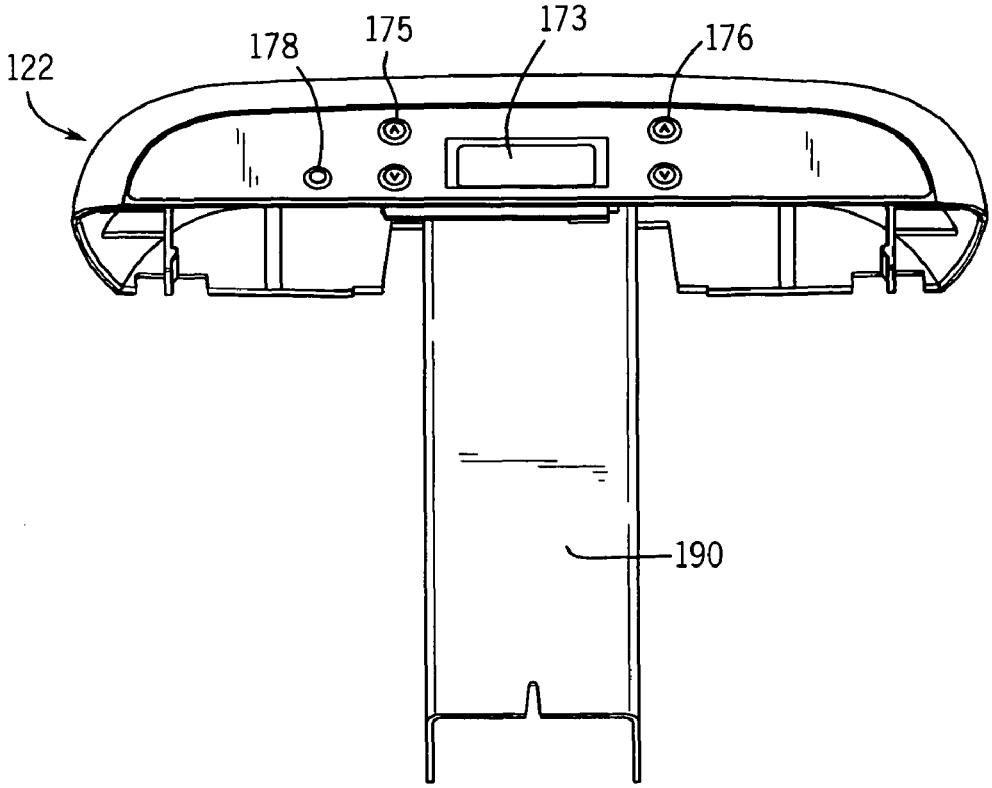
FIG. 9 shows a lower perspective view of a module of the flexible display assembly of FIGS. 3 and 4.
Figure 10:
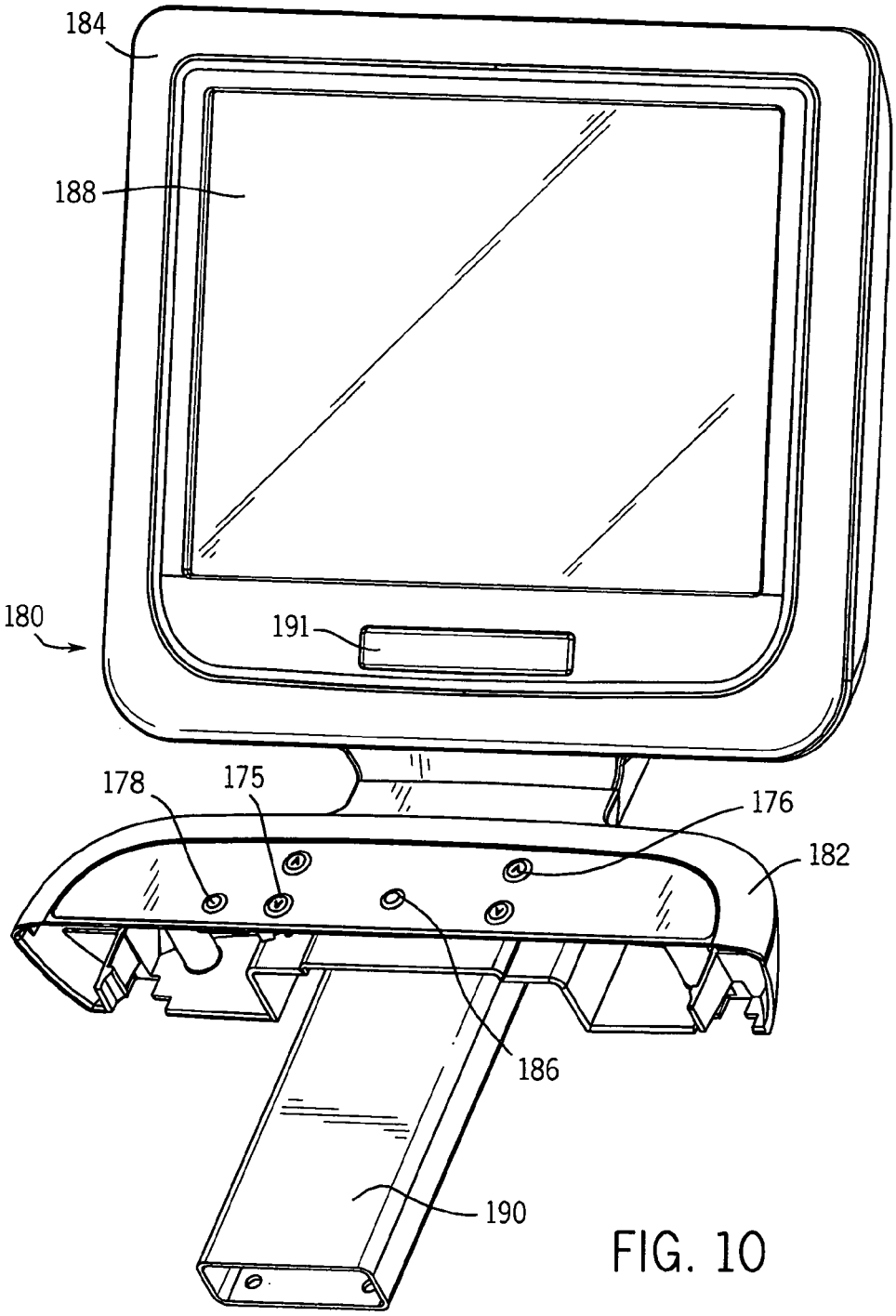
FIG. 10 shows a lower perspective view of a module of the flexible display assembly of FIGS. 5 and 6.

FIG. 8 shows a rear perspective view of a base unit 120 of a flexible display assembly in accordance with the principles of the present invention with the module removed. Referring to FIG. 9, a detailed perspective view of the first upper module 122 of the flexible display assembly of FIGS. 3 and 4 removed from the base unit 120 is seen; and FIG. 10 is a detailed perspective view of the second upper module 180 of the flexible display assembly of FIGS. 6 and 7 removed from the base unit 120. In FIG. 9, the digital display 173, the volume increment/decrement arrows 175, the channel increment/decrement arrows 176, and the mute button 178 can be seen on the module 122. In FIG. 10, the power button 186, the volume increment/decrement arrows 175, the channel increment/decrement arrows 176, and the mute button 178 can be seen on the base unit cap 182 while the video display screen 188 and the video information screen 191 can be seen on the personal viewing video display 184.

The modules 122 and 180 are particularly designed to be easily added and removed from the base unit 120. As such, a support bracket 190 can be provided extending downwardly from the modules 122 and 180. The support bracket 190 is adopted to extend into housing provided in the base unit 120; in FIG. 8, the base unit 120 of the present invention is seen with the support bracket 190 extending into the housing. Thus, the customer can choose from the various options of the modules. If a customer desires for example an option of audio entertainment only, an exercise device can be efficiently provided. Likewise, if a customer desires for example an option of audio/video entertainment, an exercise device can be efficiently provided.

Thus, it is also a particular advantage of the present invention that the modules can be interchanged with minimal effort on behalf of the factory workers or service engineers. By providing the exercise display and control functionality in the base unit separate from the module, in addition to the support bracket the only connection that is required to be made is a power and data connection. Of course, additional structural connections such as fasteners can be provided to further support the module.

Thus, by simply changing modules different options can be easily provided to customers. In addition, regardless of which module option a customer chooses, the exercise device and the base unit can be mass produced providing economies of scale in production, inventorying, warehousing, etc. thereby helping to keep costs low.

While the invention has been described with specific embodiments, other alternatives, modifications and variations will be apparent to those skilled in the art. As previously described, while the example embodiment depicts a total body elliptical fitness cross-training device, the principles of the present invention apply to any other fitness devices, including but not limited to treadmills, stair climbers, stationary bikes, rowing machines, stair climbers, weight resistance machines and the like. Accordingly, it will be intended to include all such alternatives, modifications and variations set forth within the spirit and scope of the appended claims.

What is claimed is:

1. A display assembly for a fitness trainer comprising:

a base module including; a processor; a hardware circuit board in communication with the processor;

memory in communication with the hardware circuit board and the processor;

a first front operating surface including at least one control and at least one display window disposed on the front operating surface; and a supplemental module removably coupled to and capping the base module such that the supplemental module and the base model cannot rotate relative to one another, wherein the supplemental module may be separated from the base module, the supplemental module having a second front surface including at least one control, wherein the first front operating surface terminates at a first edge, and the second front surface terminates at a second edge, wherein the first edge and the second edge are in abutment along a junction such that the first front operating surface and the second front surface are coplanar along the junction to form, in combination, a generally continuous and generally planar operating surface extending across the junction.

2. The display assembly of claim 1, wherein the supplemental module includes at least one control and/or at least one display window.

3. The display assembly of claim 2, wherein the supplemental module is an entertainment module, and wherein the at least one control and/or display window are directed to controlling and/or displaying entertainment.

4. The display assembly of claim 1 further wherein the at least one control and the at least one display window of the base module are configured to control and monitor the operation of the fitness trainer.

5. The display assembly of claim 4 wherein the base portion further comprises a publication holder positioned such that at least one of the controls is exposed when a publication is present on the holder.

6. The display assembly of claim 1, further comprising a jack assembly removably coupled to the base module.

7. The display assembly of claim 6, wherein the jack assembly is centrally positioned at the lower end of the base module.

8. The display assembly of claim 1 further wherein the supplemental module includes at least one display window, and wherein the display window comprises an audio digital display of radio frequency.

9. The display assembly of claim 1 further wherein the supplemental module comprises a personal viewing video display.

10. The display assembly of claim 1, wherein the supplemental module has a second surface parallel and continuous with the first front operating surface and wherein the second surface is formed without a control and without a display window.

11. The display assembly of claim 1 further wherein the supplemental module includes a support bracket extending downwardly from the module, the support bracket adapted to extend into housing provided in the base module.

12. The display assembly of claim 1 further wherein the supplemental module comprises an entertainment module selected from the group comprising audio entertainment, video entertainment, and audio and video entertainment.

13. The display assembly of claim 1 further wherein the base module comprises exercise information displays and exercise controls.

14. The display assembly of claim 1, wherein the supplemental module includes a support bracket projecting into the base module and projecting opposite to and behind the first front operating surface such that the first front operating surface and the support bracket overlap in a direction perpendicular to the first front operating surface.

15. The display assembly of claim 1, wherein the first front operating surface has a first width and wherein the second front surface has the first width.

16. The display assembly of claim 1, wherein the base module had a first side surface facing in a direction perpendicular to the first front operating surface, wherein the supplemental module had a second side surface facing in the direction perpendicular to the first front operating surface and wherein the first side surface and the second side surface abut, are contiguous and are coplanar.

17. The display assembly of claim 1, wherein the supplemental module comprises a video display as wide as the base module.

18. The display assembly of claim 1, wherein the supplemental module comprises:

a base unit cap having the second front surface; and a video display and extending from the base unit cap, wherein the second front surface and the first front operating surface extend in a first plane and wherein the video display extends in a second plane oblique to the first plane.

19. A display assembly for a fitness trainer comprising:

a base module including; a processor; a hardware circuit board in communication with the processor;

memory in communication with the hardware circuit board and the processor; and a first front operating surface including at least one control and at least one display window disposed on the front operating surface; and a supplemental module removably coupled to the base module, the supplemental module having a second front surface including at least one control, wherein the base module includes an upper edge, wherein the supplemental module includes a lower edge and wherein the upper edge and the lower edge abut such that the first front operating surface and the second front surface are substantially flush and coplanar.

20. The display assembly of claim 19, wherein the supplemental module includes a support bracket projecting into the base module and projecting behind the first front operating surface such that the first front operating surface and the support bracket overlap in a direction perpendicular to the first front operating surface.

21. The display assembly of claim 19, wherein the first front operating surface has a first width and wherein the second front surface has the first width.

22. The display assembly of claim 19, wherein the first front operating surface and the second front surface are contiguous and co-planar, wherein the base module had a first side surface facing in a direction perpendicular to the first front operating surface, wherein the supplemental module had a second side surface facing in the direction perpendicular to the first front operating surface and wherein the first side surface and the second side surface abut, are contiguous and are coplanar.

23. The display assembly of claim 19, wherein the supplemental module comprises a video display as wide as the base module.

24. The display assembly of claim 19, wherein the supplemental module comprises:

a base unit cap having the second front surface; and a video display and extending from the base unit cap, wherein the second front surface and the first front operating surface extend in a first plane and wherein the video display extends in a second plane oblique to the first plane.

25. A display assembly for a fitness trainer comprising:

a base module including; a processor, a hardware circuit board in communication with the processor;

memory in communication with the hardware circuit board and the processor;

a first front operating surface including at least one control and at least one display window disposed on the front operating surface; and a supplemental module removably coupled to the base module such that the supplemental module and the base module cannot rotate relative to one another, the supplemental module including at least one control and having a second front surface, wherein the base module includes an upper edge, wherein the supplemental module includes a lower edge and wherein the upper edge and the lower edge abut such that the first front operating surface and the second front surface are substantially flush and coplanar, wherein the supplemental module includes a support bracket projecting into the base module and projecting behind the first front operating surface such that the first front operating surface and the support bracket overlap in a direction perpendicular to the first front operating surface, wherein the first front operating surface has a first width and wherein the second front surface has the first width.

26. The display assembly of claim 25, wherein the supplemental module comprises:

a base unit cap having the second front surface; and a video display and extending from the base unit cap, wherein the second front surface and the first front operating surface extend in a first plane and wherein the video display extends in a second plane oblique to the first plane.

* * * * *